US008641248B2

(12) United States Patent
Chen

(10) Patent No.: US 8,641,248 B2
(45) Date of Patent: Feb. 4, 2014

(54) HOLDER OF LIGHTING DEVICE

(75) Inventor: Yu Ta Chen, Kaohsiung (TW)

(73) Assignee: Dafun Design Consultant Co., Ltd., Kaohsiung (TW)

( * ) Notice: Subject to any disclaimer, the term of this patent is extended or adjusted under 35 U.S.C. 154(b) by 95 days.

(21) Appl. No.: 13/351,207

(22) Filed: Jan. 16, 2012

(65) Prior Publication Data

US 2012/0188776 A1 Jul. 26, 2012

(30) Foreign Application Priority Data

Jan. 20, 2011 (TW) ..... 100201311 U

(51) Int. Cl.
*F21V 21/08* (2006.01)

(52) U.S. Cl.
USPC ..... 362/396; 362/652; 439/699.2

(58) Field of Classification Search
USPC ..... 362/396, 652, 655, 656; 439/220, 236, 439/602, 699.2
See application file for complete search history.

(56) References Cited

U.S. PATENT DOCUMENTS 5,361,191 A * 11/1994 Matsuzaki et al. ..... 362/549
5,513,082 A * 4/1996 Asano ..... 362/656
5,895,295 A * 4/1999 Harada ..... 439/699.2
7,360,922 B1 * 4/2008 Yeh ..... 362/217.05

* cited by examiner

*Primary Examiner* — John A Ward
(74) *Attorney, Agent, or Firm* — Leong C. Lei

(57) ABSTRACT

A holder of lighting device is provided for receiving a lighting unit of the lighting device to be inserted and retained therein. The lighting unit includes an insertion portion that is insertable into the holder. The holder includes a clamp section, which defines a receiving and retaining space, and a base, which extends outwards and downwards from the clamp section. The clamp section includes a plurality of pawls that circumferentially surrounds a center of the receiving and retaining space and is engageable with and thus resiliently clamps the insertion portion of the lighting unit. The base can be stably positioned on a flat surface and the pawls resiliently clamp the insertion portion of the lighting unit so that the stability of positioning the lighting unit can be improved.

5 Claims, 3 Drawing Sheets

HOLDER OF LIGHTING DEVICE

TECHNICAL FIELD OF THE INVENTION

The present invention generally relates to a holder, and more particularly to a holder that selectively receives a lighting unit, such as a flashlight, to insert therein to allow the lighting unit to be positioned in a more secured manner.

DESCRIPTION OF THE PRIOR ART

There are a variety of classes and types of generally household lighting devices. Some of the lighting devices are mounted on for example walls and ceilings for indoor illumination. A desk lamp, however, is designed for local illumination of a limited space and is thus suitable for being positioned on a desktop to illuminate an area that requires intense lighting. Other lighting devices, such as a flashlight or an indication light, are compact and small-sized lighting devices suitable for hand carrying outdoors to provide a concentrated and straight lighting for a dark outdoor environment.

To change the way how a portable lighting device, such as a flashlight, can be used in order to enhance the utilization thereof, the present inventor proposed in Taiwan Utility Model No. M373444 a shade to be fit to a lighting unit, such as a flashlight, whereby with the arrangement of such a shade, the direction of lighting from the flashlight can be changed. This allows the flashlight to be positioned on for example a desktop to serve as local lighting for a desired area. In this way, the lighting device disclosed in the Utility Model can change the way of use of an existing lighting device and thus shows enhanced utilization of the lighting device.

Such a conventional device provides a shade having a unique structure for changing the direction of lighting of a lighting unit. However, a flashlight is generally designed to be held by a hand and cannot be stably positioned in an upright condition. Some of the flashlights available in the market may be even provided with a raised or projecting portion on a bottom thereof, which makes it hardly possible for such flashlights to stand on a flat surface. The lighting shade disclosed in the above mentioned prior art reference can only be used in limited types of lighting units and this imposes an undesired limitation to the use thereof.

SUMMARY OF THE INVENTION

An objective of the present invention is to provide a holder of lighting device that holds, with enhanced stability, a lighting unit.

The present invention provides a holder of lighting device in which a lighting unit of the lighting device is receivable and retained. The lighting unit comprises an insertion portion that is insertable into the holder. The holder comprises a clamp section, which defines a receiving and retaining space, and a base, which extends outwards and downwards from the clamp section. The clamp section comprises a plurality of pawls that circumferentially surrounds a center of the receiving and retaining space and is engageable with and thus resiliently clamps the insertion portion of the lighting unit.

The efficacy of the present invention is that the base can be stably positioned on a flat surface and the pawls resiliently clamp the insertion portion of the lighting unit so that the stability of positioning the lighting unit can be improved.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
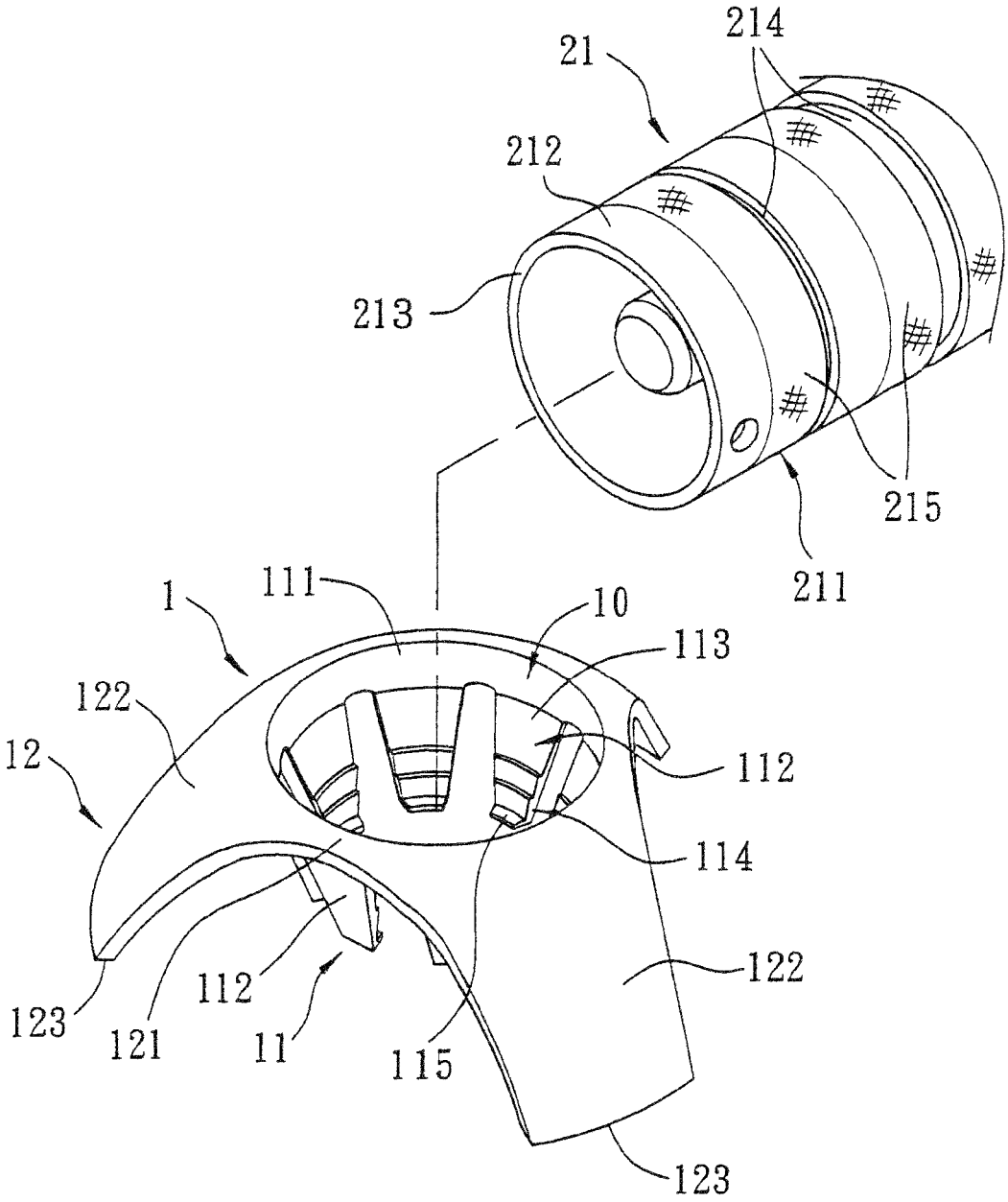
FIG. 1 is a perspective view showing a holder according to a preferred embodiment of the present invention.
Figure 2:
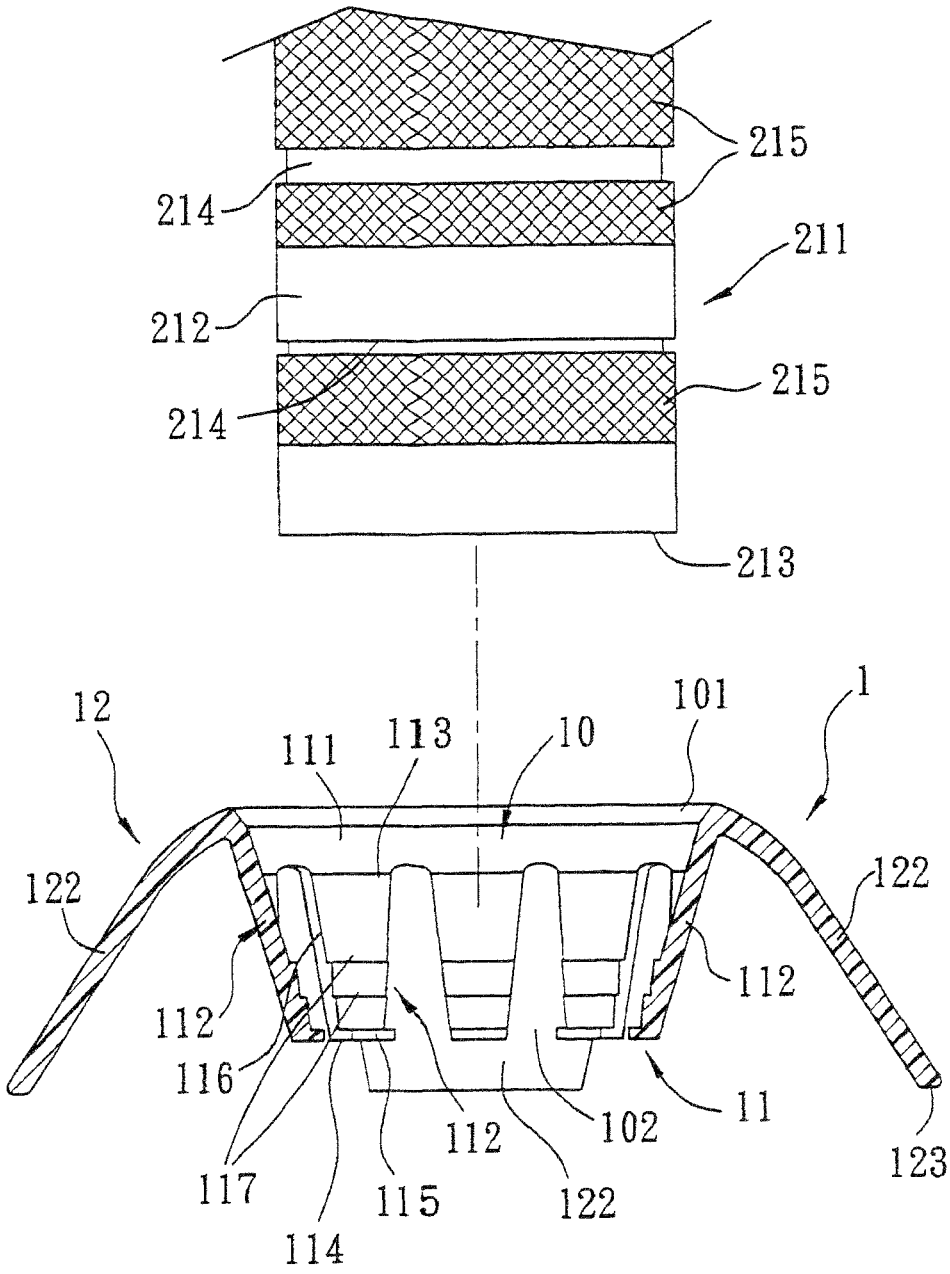
FIG. 2 is a cross-sectional view of the holder according to the preferred embodiment of the present invention.
Figure 3:
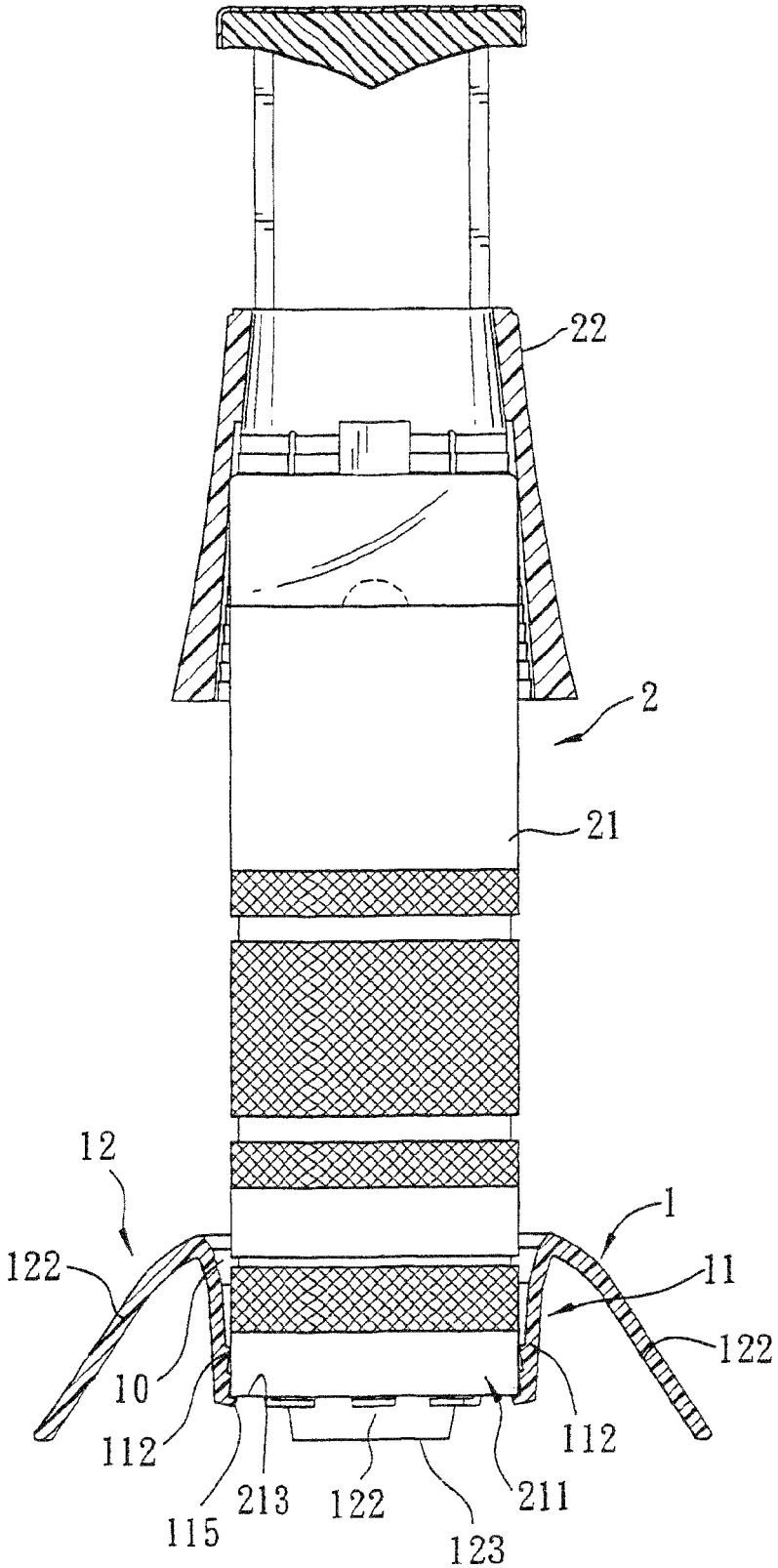
FIG. 3 is a cross-sectional view illustrating the use of the holder according to the preferred embodiment of the present invention, spatial relationship among components of the holder and a lighting device being shown.

Referring to FIGS. 1, 2, and 3, a holder constructed in accordance with a preferred embodiment of the present invention, generally designated at 1, constitutes a component of a lighting device 2. The lighting device 2 also comprises a lighting unit 21 that is releasably inserted into the holder 1 to show an upright erected condition and a shade 22 that is fit to the lighting unit 21 to change the direction of lighting of the lighting unit 21. The lighting unit 21 comprises an insertion portion 211 that has a circular cross section and is adjacent to a lower end of the lighting unit. The insertion portion 211 has a surface 212 circumferentially extending about a center and a bottom end face 213 formed below the surface 212. The surface 212 forms a plurality of circumferential grooves 214 and a plurality of rough ring sections 215.

The holder 1 of the illustrated embodiment comprises a clamp section 11 that defines a receiving and retaining space 10 and a base 12 that extends outward from a top edge of the clamp section 11 and then extends downward. The clamp section 11 comprises a circumferential wall 111 that is arranged at an upper portion of the clamp section and connected to the base 12 and a plurality of pawls 112 that surrounds a center of the receiving and retaining space 10 and show resiliency. Each of the pawls 112 has a root end 113 adjacent to the upper portion and a bearing end 114 having a gradually reduced width and located at a lower portion. The bearing end 114 forms a support flange 115 that extends horizontally toward the receiving and retaining space 10. Each of the pawls 112 has an inner support face 116 facing toward the receiving and retaining space 10. The inner support face 116 forms thereon a plurality of ridges 117.

The receiving and retaining space 10 of the illustrated embodiment is surrounded by the clamp section 11, so that the receiving and retaining space 10 has a large-diameter portion 101 located at the upper portion and a small-diameter portion 102 located among the support flanges 115. The insertion portion 211 of the lighting unit 21 has an outside diameter smaller than the large-diameter portion 101 of the receiving and retaining space 10, but larger than the small-diameter portion 102 of the receiving and retaining space 10.

The base 12 of the illustrated embodiment comprises a base circumferential wall 121 that extends outward from a top edge of the circumferential wall 111 in a curved form and a plurality of support leg walls 122 that extends outwards and downwards in an equally angularly spaced manner. Each of the support leg walls 122 has a bottom end 123 that is lower than the support flanges 115 of the clamp section 11.

To use the holder 1 of the illustrated embodiment, the insertion portion 211 of the lighting unit 21 is inserted into the receiving and retaining space 10 and after the insertion, since the pawls 112 of the holder 1 are arranged to gradually prone toward the center in a direction from the lower side to the upper side and since the small-diameter portion 102 of the receiving and retaining space 10 is smaller than the outside diameter of the insertion portion 211 of the lighting unit 21, when the bottom end face 213 of the lighting unit 21 is positioned on the support flanges 115 of the pawls 112 of the holder 1, the pawls 112 tightly engage with and thus clamp the insertion portion 211 of the lighting unit 21. Since the base 12 of the holder 1 according to the present invention is arranged to gradually expand in an outward direction and is lower than the clamp section 11, after being installed, the holder may make use of the outward expansion of the base 12 to enhance the stability of positioning and holding the lighting unit 21.

It is noted that a regular flashlight that can be used as the lighting unit 21 is designed for being hand held, and thus, it is generally not a consideration for stability of positioning and sometimes, it is even provided with a raised button or a projection at the end distant from the lighting end. The present invention provides a design that makes the bottom end 123 of the base 12 lower than the support flanges 115 of the clamp section 11 is helpful in properly raising up a possibly irregular end of the lighting unit 21, whereby the holder 1 can receive various structures of the lighting unit 21 to be inserted therein. Apparently, besides being novel in structure, the holder 1 of the present invention also offer an advantage of enhancing the stability of positioning a lighting unit 21.

The holder 1 according to the embodiment of the present invention is suitable for receiving a lighting unit 21 that has a circular cross section, such as a flashlight to be inserted therein. However, the shape and arrangement of the receiving and retaining space 10 can be properly modified to receive a lighting unit 21 having a cross section that is not circular to insert therein.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A holder of lighting device in which a lighting unit of a lighting device is receivable retained, the lighting unit comprising an insertion portion that is insertable into the holder; the holder comprising a clamp section, which defines a receiving and retaining space and comprises a plurality of pawls that circumferentially surrounds a center of the receiving and retaining space and is engageable with and thus resiliently clamps the insertion portion of the lighting unit; and a base, which extends outwards and downwards from the clamp section, wherein the clamp section comprise a circumferential wall located above and connected to the pawls, the base comprising a base circumferential wall connected to the circumferential wall and a plurality of support leg walls extending outwards and downwards from the base circumferential wall.

2. The holder according to claim 1, wherein the receiving and retaining space comprises a large-diameter portion at an upper side and a small-diameter portion at a lower side, the insertion portion of the lighting unit having an outside diameter smaller than the large-diameter portion and greater than the small-diameter portion.

3. The holder according to claim 1, wherein each of the pawls has a root end connected to the circumferential wall and a bearing end spaced from the root end, the bearing end forming a support flange extending toward the receiving and retaining space.

4. The holder according to claim 3, wherein the support leg walls of the base has a bottom end lower than the support flanges of the pawls.

5. The holder according to claim 1, wherein each of the pawls has an inner support face that opposes the receiving and retaining space, the inner support face forming at least one ridge.

* * * * *